US007011568B2

(12) United States Patent
Sorrell

(10) Patent No.: US 7,011,568 B2
(45) Date of Patent: Mar. 14, 2006

(54) GRINDER WITH ADJUSTABLE TOOL REST

(76) Inventor: Roger Lynn Sorrell, 9804 Southview Ct., Raleigh, NC (US) 27603

( * ) Notice: Subject to any disclaimer, the term of this patent is extended or adjusted under 35 U.S.C. 154(b) by 0 days.

(21) Appl. No.: 10/870,013

(22) Filed: Jun. 17, 2004

(65) Prior Publication Data

US 2005/0026550 A1 Feb. 3, 2005

Related U.S. Application Data

(60) Provisional application No. 60/480,463, filed on Jun. 20, 2003.

(51) Int. Cl.
*B24B 49/00* (2006.01)
*B24B 51/00* (2006.01)

(52) U.S. Cl. ..... 451/21

(58) Field of Classification Search ..... 451/21, 451/45, 193, 203, 293, 223, 41
See application file for complete search history.

(56) References Cited

U.S. PATENT DOCUMENTS 6,364,750 B1 * 4/2002 Bauer ..... 451/45
6,368,196 B1 * 4/2002 Bauer ..... 451/293
6,383,057 B1 * 5/2002 Bartlett et al. ..... 451/7

* cited by examiner

*Primary Examiner*—Lee D. Wilson
(74) *Attorney, Agent, or Firm*—Coats & Bennett, P.L.L.C.

(57) ABSTRACT

A grinding tool with a toll rest includes an adjustment mechanism to adjust the position of the tool rest responsive to wear of the grinding wheel.

4 Claims, 2 Drawing Sheets

GRINDER WITH ADJUSTABLE TOOL REST

RELATED APPLICATIONS

This application claims priority under 35 U.S.C. § 119(e) from the following provisional application: U.S. Provisional Application Ser. No. 60/480,463 filed on Jun. 20, 2003. That application is incorporated in its entirety by reference herein.

SUMMARY OF THE INVENTION

The invention relates to a grinder with an adjustable tool rest to maintain a relatively constant distance between the tool rest and the grinding wheel as the grinding wheel wears down.

DETAILED DESCRIPTION OF THE INVENTION

Figure 1:
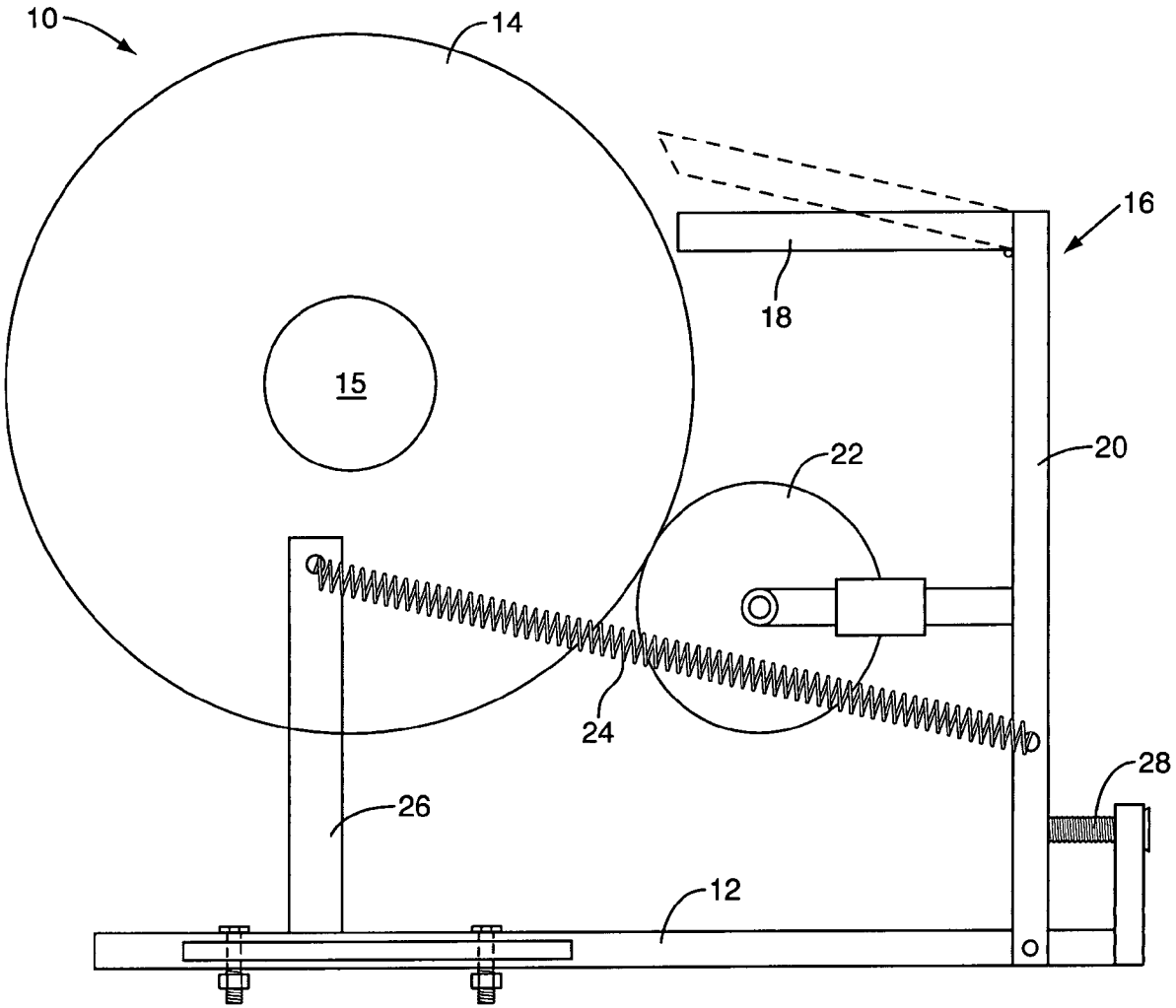
FIG. 1 is a side elevational view of a grinding wheel according to a first embodiment.
Figure 3:
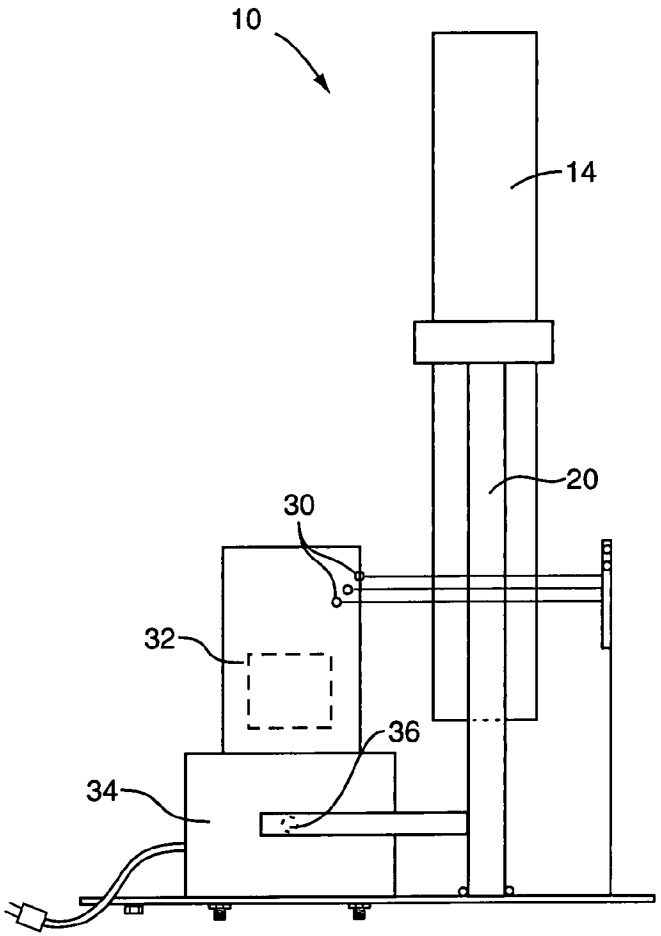
FIG. 3 is an end view of the grinding wheel in the second embodiment.
Figure 2:
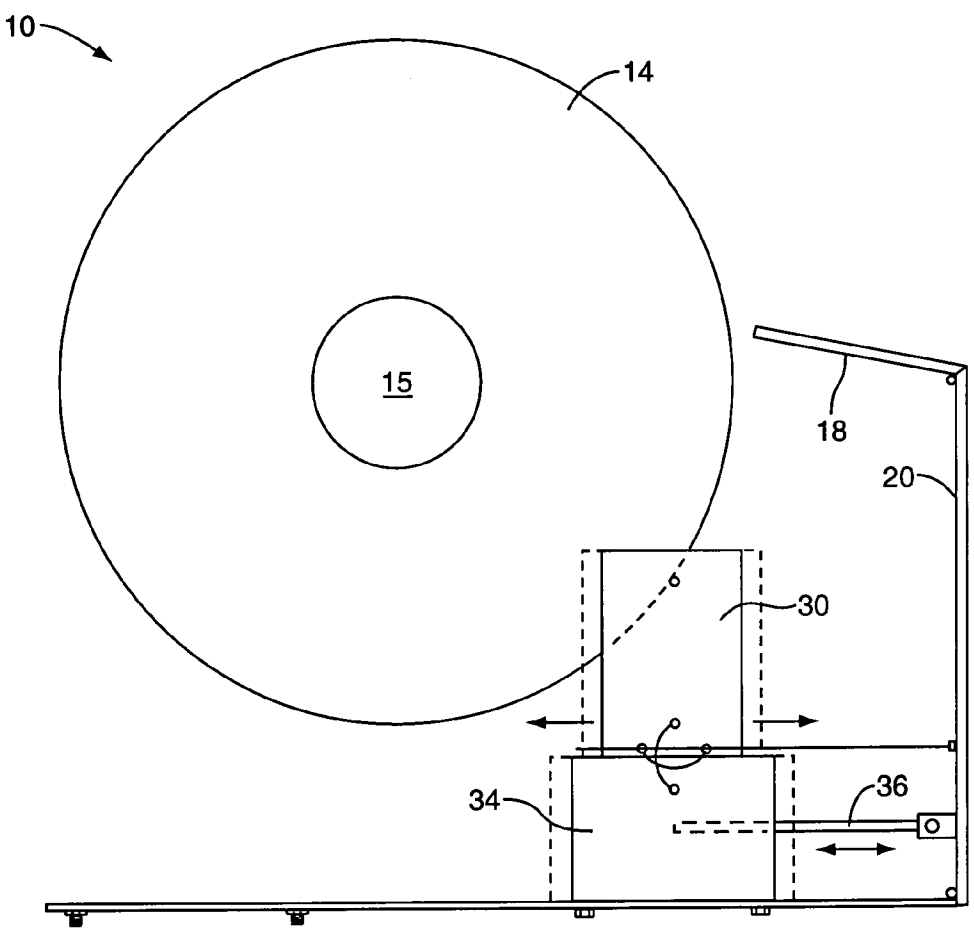
FIG. 2 is a side elevational view of a grinding wheel according to a second embodiment.

FIGS. 1–3 show a grinder 10 according to a various embodiments of the invention. The grinder 10 comprises a base 12, a grinding wheel 14 rotatably mounted to the base 12, and a motor 15 for rotating the grinding wheel 14. The motor 15 may drive the grinding wheel 14 directly. Alternatively, the driving force may be transmitted from the motor 15 to the grinding wheel 14 via a drive train. The particular manner of supporting and driving the grinding wheel 14 is not a material aspect of the invention.

A tool rest 16 is movably mounted to the base 12. The function of the tool rest 16 is to support a tool, such as a chisel, or other work piece while grinding. In broad terms, the invention comprises a mechanism for maintaining the spacing between the tool rest 16 and the grinding wheel 14 as the grinding wheel 14 wears down. Various mechanisms for maintaining the spacing between the tool rest and the grinding wheel are described.

In the embodiment shown in FIG. 1, the tool rest 16 comprises an angularly-adjustable resting plate 18 pivotably mounted to the upper end of a vertical support member 20. The vertical support member 20 is pivotably mounted at its lower end to the base 12. A guide roller 22 is mounted to an intermediate portion of the vertical support 20 and is adapted to engage the outer edge of the grinding wheel 14. A spring or other biasing member 24 applies a biasing force to the tool rest 16 to move the tool rest toward the grinding wheel 14 until the guide roller 22 engages the grinding wheel 14. One end of the spring 24 connects to the vertical support and the other end of the spring 24 connects to a spring arm 26 attached to the base 12. The spring 24 holds the guide roller 22 in contact with the grinding wheel 14 as the grinding wheel 14 wears down, thereby maintaining the spacing between the tool rest 16 and the grinding wheel 14.

In an alternate embodiment shown in FIG. 2, an optical detector 30 is used to detect the outer circumference of the grinding wheel 14. The optical detector 30 may comprise a single beam or multiple beams of light. A microprocessor 32 and servo motor 34 adjust the position of the tool rest 16 based on the output signal from the optical detector. The servo-motor 34 drives a shaft 36 that connects to the vertical support 20.

Other elements of my invention which may be used with either embodiment include an adjustment mechanism for adjusting the tension on the biasing spring 24, and an anti-kickback device 28 to prevent the tool rest from kicking back when an object gets caught in the gap between the tool rest and grinding wheel. A safety mechanism could also be provided to shut off power to the grinding wheel 14 when kickback is detected.

Those skilled in the art will recognize that the invention may be modified in various ways. For example, the tool rest could be mounted for linear movement, rather than rotational movement as shown in FIGS. 1 and 2. Also, in the second embodiment, detectors other than optical detectors could be used to detect the outer circumference of the grinding wheel. Such variations are within the scope of my invention.

What is claimed is:

1. A grinding tool comprising:
a base;
a grinding wheel rotatably mounted to the base;
a tool rest movably connected to the base;
means to adjust the position of the tool rest responsive to wear of the grinding wheel.

2. A grinding tool comprising:
a base;
a grinding wheel rotatably mounted to the base;
a tool rest movably connected to the base; and
a guide roller connected to the tool rest;
a biasing member biasing the tool rest such that the guide roller contacts the grinding wheel.

3. A grinding tool comprising:
a base;
a grinding wheel rotatably mounted to the base;
a tool rest movably connected to the base; and
an optical detector to detect the circumference of the grinding wheel;
a servo-motor to adjust the position of the tool rest responsive to the detection of the grinding wheel by the optical detector.

4. A grinding tool comprising:
a base;
a grinding wheel rotatably mounted to the base;
a tool rest movably connected to the base;
an adjustment mechanism to adjust the position of the tool rest responsive to wear of the grinding wheel.

* * * * *